US005799447A

United States Patent [19]

Lee

[11] Patent Number: 5,799,447

[45] Date of Patent: Sep. 1, 1998

[54] APPARATUS FOR MOVING A WALL FORM ASSEMBLY

[76] Inventor: Kou-An Lee, No. 851, Chung-Shan Rd., Nan-Shing Tsun, Kui-Jen Hsiang, Tainan Hsien, Taiwan

[21] Appl. No.: 890,777

[22] Filed: Jul. 11, 1997

[51] Int. Cl.[6] ..... E04G 11/20

[52] U.S. Cl. ..... 52/127.1; 249/219.2

[58] Field of Search ..... 52/127.1, 127.2; 187/267, 268; 249/44, 47, 219.2; 414/10, 11, 12

[56] References Cited

U.S. PATENT DOCUMENTS

| | | | |
|---|---|---|---|
| 2,503,388 | 4/1950 | Hedlund | 414/10 |
| 5,544,852 | 8/1996 | Lee | 249/192 |

FOREIGN PATENT DOCUMENTS

| | | | |
|---|---|---|---|
| 651338 | 1/1964 | Belgium | 52/127.2 |
| 6-185218 | 7/1994 | Japan | 52/127.2 |

*Primary Examiner*—Janice L. Krizek

*Attorney, Agent, or Firm*—Merchant, Gould, Smith, Edell, Welter & Schmidt, P.A.

[57] ABSTRACT

An apparatus for moving a wall form assembly on a floor includes an upright tubular seat which has upper and lower portions and which confines an axial hole through the upper and lower portions. The upper portion has an internally threaded top section. The lower portion is provided with a radial support projection. A horizontal beam has a front end and a rear end mounted on the upper portion of the tubular seat. A hook member is mounted on the front end of the horizontal beam. A rotary shaft is disposed rotatably in the axial hole and has an upper end and a lower end that extends out of the tubular seat and that has a roller mounted thereon. An operating member includes a threaded shank which has a lower section that extends threadedly into the axial hole via the internally threaded top section of the tubular seat and that is coupled to the upper end of the shaft. The tubular seat is movable upward or downward relative to the shaft upon rotation of the threaded shank so as to permit raising or lowering of the wall form assembly relative to the floor to facilitate adjustment of a position of the wall form assembly on the floor.

2 Claims, 4 Drawing Sheets

APPARATUS FOR MOVING A WALL FORM ASSEMBLY

BACKGROUND OF THE INVENTION

1. Field of the Invention

The present invention relates to an apparatus for moving a wall form assembly on a floor of a concrete structure.

2. Description of the Related Art

Modular wall form assemblies which permit high-quality construction of concrete partition walls have grown in popularity in recent years. When constructing partition walls on a floor of a concrete structure, the modular wall form assemblies are assembled into a number of multi-sided units which are subsequently hoisted to predetermined positions on the floor. Concrete is then poured into pouring spaces defined between adjacent ones of the wall form assemblies, thereby forming the concrete partition walls when the concrete hardens.

A conventional modular wall form assembly, such as that disclosed in U.S. Pat. No. 5,544,852, for forming a concrete partition wall is shown in FIG. 1. The modular wall form assembly 1 includes four vertical wall form panels 11 which cooperatively confine a rectangular space, and a plurality of horizontal reinforcement units 12 mounted on inner sides of the vertical wall form panels 11. Referring to FIG. 2, each of the vertical wall form panels 11 includes a plurality of channel pieces 13 coupled detachably side-by-side to one another. Each of the channel pieces 13 includes two opposing vertical webs 131 and an intermediate form wall 132 which interconnects the vertical webs 131. Each of the horizontal reinforcement units 12 includes a plurality of reinforcement members 14 interconnected detachably to each other.

In order for the modular wall form assembly 1 to be reusable and to be capable of forming high-quality concrete walls, both the channel pieces 13 and the reinforcement members 14 are made of metal, such as relatively heavy and is difficult to move when adjusting the position thereof on the floor. As such, there is a need to provide an apparatus for moving the aforementioned wall form assembly 1 on the floor.

SUMMARY OF THE INVENTION

The main object of the present invention is to provide an apparatus which has a relatively simple structure, which occupies a relatively small amount of space, and which can be used for moving a wall form assembly on a floor of a concrete structure.

Accordingly, the apparatus of the present invention is used for moving a wall form assembly that includes a plurality of vertical channel pieces coupled detachably side-by-side to one another, and a plurality of horizontal reinforcement members. Each of the channel pieces includes two opposing vertical webs and an intermediate form wall which interconnects the vertical webs. Each of the reinforcement members has opposite top and bottom sides, a mounting side which is mounted detachably on the vertical webs opposite to the form walls, and a free side opposite to the mounting side. The apparatus includes an upright tubular seat, a horizontal beam, a hook member, a rotary shaft and an operating member. The upright tubular seat is adapted to be disposed between the vertical webs of one of the channel pieces and between the mounting side of one of the reinforcement members and the form wall of said one of the channel pieces. The tubular seat has upper and lower portions and confines an axial hole through the upper and lower portions. The upper portion has an internally threaded top section. The lower portion is provided with a radial support projection which is adapted to support the bottom side of said one of the reinforcement members adjacent to the mounting side thereof. The horizontal beam has a front end and a rear end mounted on the upper portion of the tubular seat. The horizontal beam is adapted to straddle across the top side of said one of the reinforcement members in a direction from the mounting side to the free side. The horizontal beam and the support projection are adapted to clamp cooperatively said one of the reinforcement members at the mounting side thereof. The hook member is mounted on the front end of the horizontal beam and is adapted to press against the top side and the free side of said one of the reinforcement members. The rotary shaft is disposed rotatably in the axial hole of the tubular seat. The shaft has an upper end and a lower end that extends out of the tubular seat and that has a roller mounted thereon. The roller is adapted to be in rolling contact with the floor of the concrete structure. The operating member includes a threaded shank which has a lower section that extends threadedly into the axial hole of the tubular seat via the internally threaded top section of the upper portion and that is coupled to the upper end of the shaft. The tubular seat is movable upward or downward relative to the shaft upon rotation of the threaded shank so as to permit raising or lowering of the wall form assembly relative to the floor of the concrete structure to facilitate adjustment of a position of the wall form assembly on the floor.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
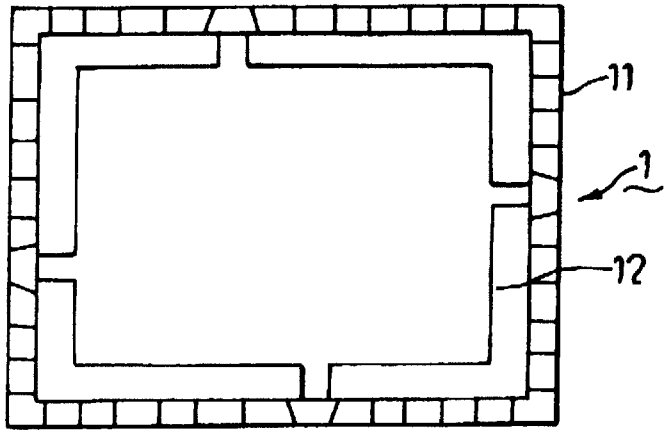
FIG. 1 PRIOR ART
FIG. 1 is a top view of a conventional modular wall form assembly.
Figure 2:
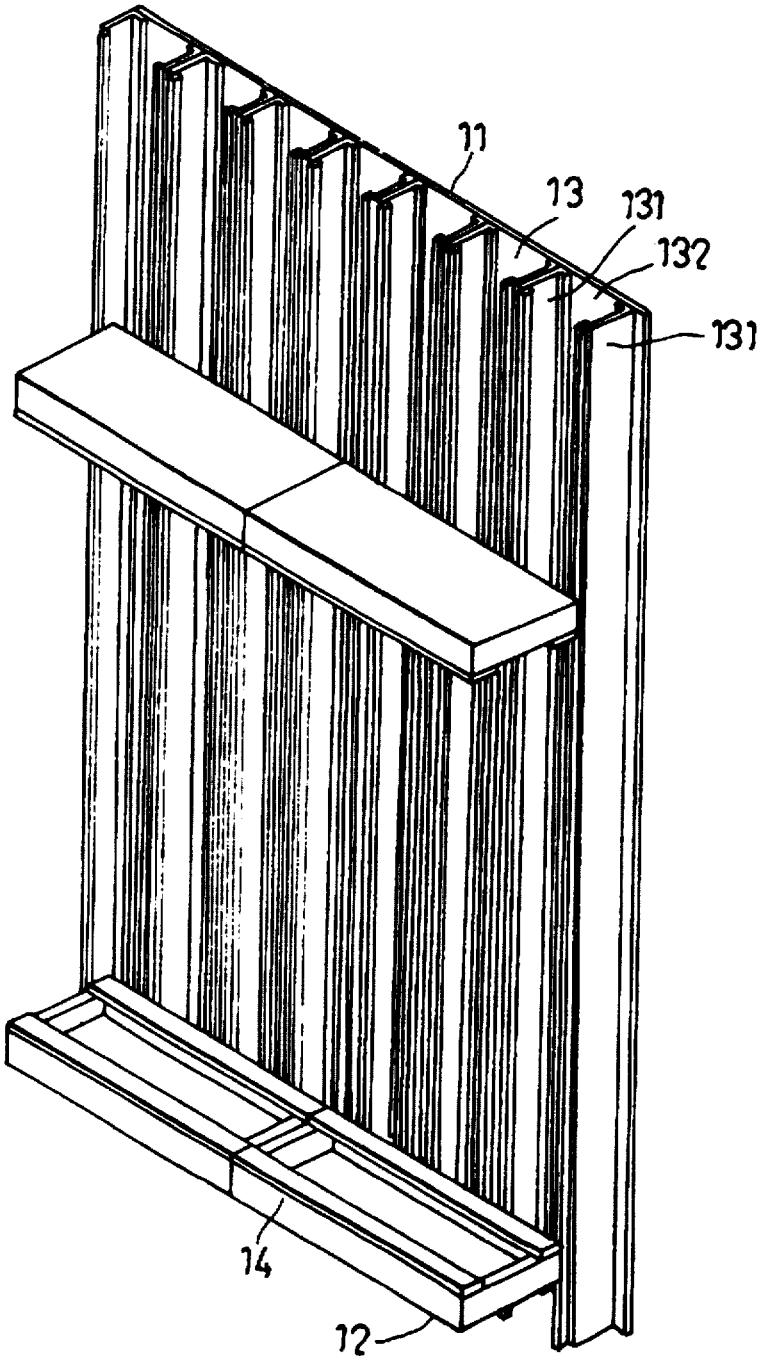
FIG. 2 PRIOR ART
FIG. 2 is a perspective view illustrating a vertical wall form panel and a reinforcement unit of the conventional modular wall form assembly.
Figure 3:
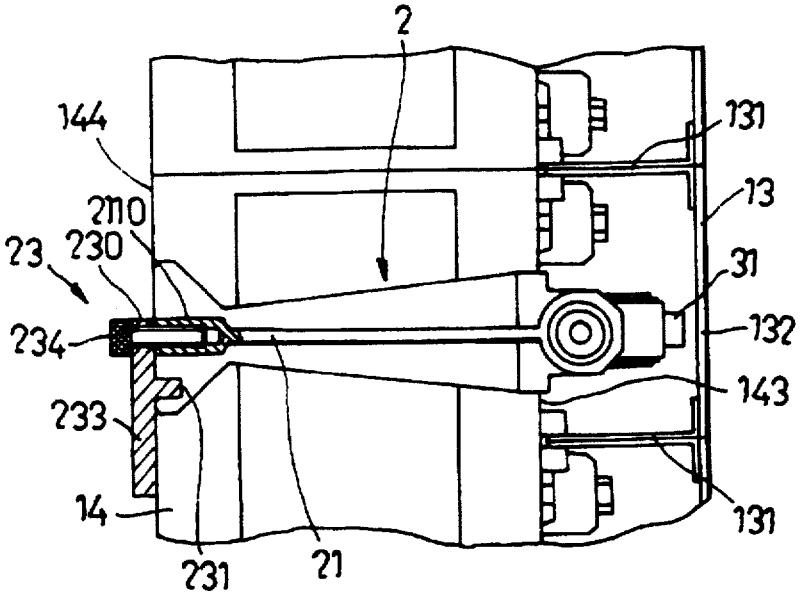
FIG. 3 is a top view illustrating an apparatus according to a preferred embodiment of the present invention when installed on the modular wall form assembly of FIG. 2.
Figure 4:
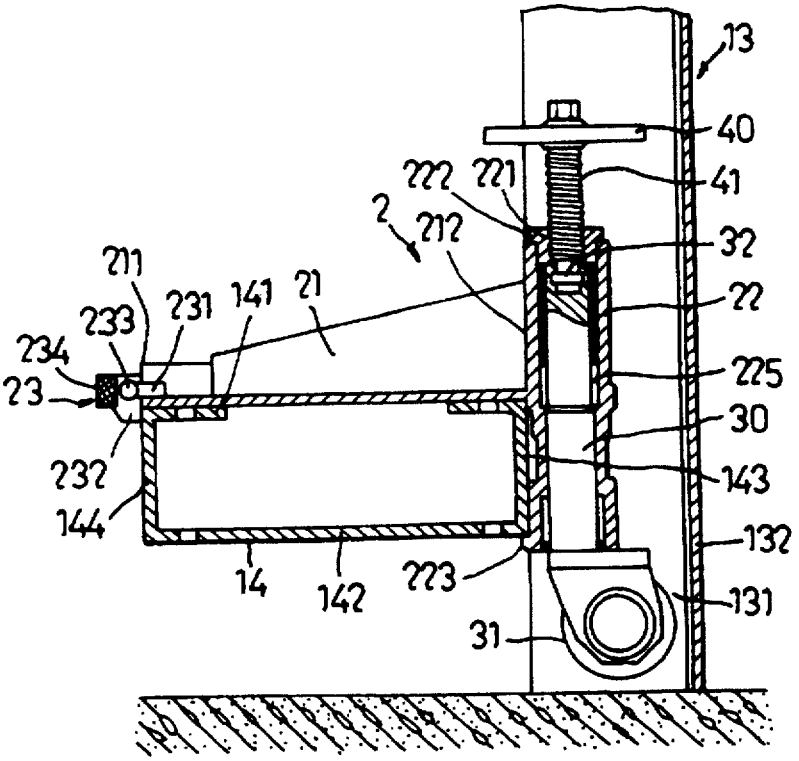
FIG. 4 is a vertical sectional view of the apparatus of FIG. 3.
Figure 5:
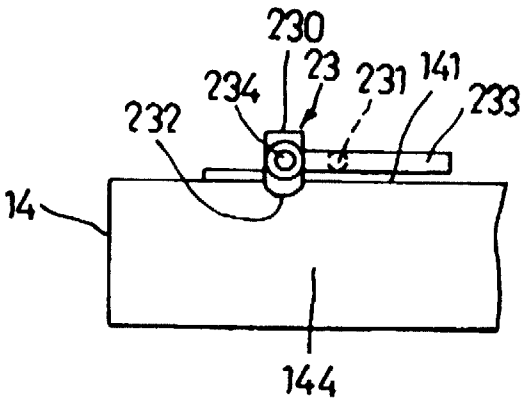
FIG. 5 is a front view illustrating a hook member of the apparatus of FIG. 3.

Referring to FIGS. 3 to 5, the apparatus 2 of the present embodiment can be used to move the conventional modular wall form assembly 1 shown in FIGS. 1 and 2, which includes a plurality of vertical channel pieces 13 and a plurality of horizontal reinforcement members 14. Each of the channel pieces 13 includes two opposing vertical webs 131 and an intermediate form wall 132 which interconnects the vertical webs 131. Each of the horizontal reinforcement members 14 has opposite top and bottom sides 141, 142, a mounting side 143 which is mounted detachably on the vertical webs 131, and a free side 144 opposite to the mounting side 143. The apparatus 2 is shown to comprise an upright tubular seat 22, a horizontal beam 21, a hook member 23, a rotary shaft 30 and an operating member 40.

The upright tubular seat 22 is adapted to be disposed between the vertical webs 131 of one of the channel pieces 13 and between the mounting side 143 of one of the reinforcement members 14 and the form wall 132 of said one of the channel pieces 13. The tubular seat 22 has upper and lower portions, and confines an axial hole 225 through the upper and lower portions. The upper portion of the tubular seat 22 is provided with an internally threaded sleeve 222 that is mounted on a top end of the tubular seat 22 and that confines a threaded hole 221 aligned with the axial hole 225 of the tubular seat 22. The lower portion of the tubular seat 22 is provided with a radial support projection 223 which is adapted to support the bottom side 142 of said one of the reinforcement members 14 adjacent to the mounting side 143 thereof.

The horizontal beam 21 has a substantially inverted T-shaped configuration, a front end 211 formed with a screw socket 2110, and a rear end 212 mounted securely on the upper portion of the tubular seat 22. The horizontal beam 21 is adapted to straddle across the top side 141 of said one of the reinforcement members 14 in a direction from the mounting side 143 to the free side 144. The horizontal beam 21 and the support projection 223 of the tubular seat 22 are adapted to clamp cooperatively said one of the reinforcement members 14 at the mounting side 143 thereof.

The hook member 23 includes a mounting portion 230 mounted removably on the front end 211 of the horizontal beam 21 by means of a screw fastener 234 which engages the screw socket 2110, a downward extension 232 which extends from the mounting portion 230 and which is adapted to press against the free side 144 of said one of the reinforcement members 14, a horizontal extension 233 which extends from the mounting portion 230, and a transverse projection 231 formed on the horizontal extension 233 and adapted to press the horizontal beam 21 against the top side 141 of said one of the reinforcement members 14.

The rotary shaft 30 is disposed rotatably in the axial hole 225 of the tubular seat 22. The rotary shaft 30 has an upper end formed with a blind coupling hole 32 and a lower end that extends out of the tubular seat 22 and that has a roller 31 mounted thereon. The roller 31 is adapted to be in rolling contact with the floor of the concrete structure.

The operating member 40 includes a threaded shank 41 which has a lower section that extends threadedly into the axial hole 225 of the tubular seat 22 via the internally threaded sleeve 222. The lower section of the threaded shank 41 extends into the coupling hole 32 in the upper end of the rotary shaft 30 and is coupled rotatably to the upper end of the shaft 30.

In use, the apparatus 2 is mounted on the conventional modular wall form assembly 1 of FIGS. 1 and 2 in such a manner that the tubular seat 22 is disposed between the vertical webs 131 of one of the channel pieces 13 and between the mounting side 143 of one of the reinforcement members 14 and the form wall 132 of said one of the channel pieces 13 (see FIG. 3), that the horizontal beam 21 rests on and straddles across the top side 141 of said one of the reinforcement members 14, and that the support projection 223 supports the bottom side 142 of said one of the reinforcement members 14 (see FIG. 4). The hook member 23 is then mounted as shown in FIG. 5 to press against the free side 144 and against the top side 141 of said one of the reinforcement members 14. After the apparatus 2 has been mounted stably on said one of the reinforcement members 14, the operating member 40 is operated. Since the lower section of the operating member 40 is coupled to the upper end of the shaft 30, and since the roller 31 is in contact with the floor, rotation of the operating member 40 can result in upward movement of the tubular seat 22 relative to the rotary shaft 30, thereby raising the wall form assembly 1 together with the tubular seat 22 relative to the floor of the concrete structure. The modular wall form assembly 1 can thus be moved on the floor with the assistance of the roller 31, which significantly reduces the friction between the wall form assembly 1 and the floor to facilitate movement of the wall form assembly 1. After the wall form assembly 1 has been moved to the desired position, the operating member 40 is operated once again in a reverse direction to move the wall form assembly 1 downward together with the tubular seat 22.

It is noted that the rotary shaft 30 is disposed rotatably in the tubular seat 22. The roller 31 is capable of rotating in a 360° range. Therefore, the wall form assembly 1 can be moved on the floor in all directions. Accordingly, the apparatus of the present invention is an indispensable aid during the adjustment of a position of the modular wall form assembly on the floor of the concrete structure.

With this invention thus explained, it is apparent that numerous modifications and variations can be made without departing from the scope and spirit of this invention. It is therefore intended that this invention be limited only as indicated in the appended claims.

I claim:

1. An apparatus for moving a wall form assembly on a floor of a concrete structure, the wall form assembly including a plurality of vertical channel pieces coupled detachably side by side to one another, each of the channel pieces including two opposing vertical webs and an intermediate form wall which interconnects the vertical webs, the wall form assembly further including a plurality of horizontal reinforcement members, each of the reinforcement members having opposite top and bottom sides, a mounting side which is mounted detachably on the vertical webs opposite to the form walls, and a free side opposite to the mounting side, said apparatus comprising:

an upright tubular seat adapted to be disposed between the vertical webs of one of the channel pieces and between the mounting side of one of the reinforcement members and the form wall of said one of the channel pieces, said tubular seat having upper and lower portions and confining an axial hole through said upper and lower portions, said upper portion having an internally threaded top section, said lower portion being provided with a radial support projection which is adapted to support the bottom side of said one of the reinforcement members adjacent to the mounting side thereof;

a horizontal beam having a front end and a rear end mounted on said upper portion of said tubular seat, said horizontal beam being adapted to straddle across the top side of said one of the reinforcement members in a direction from the mounting side to the free side, said horizontal beam and said support projection being adapted to clamp cooperatively said one of the reinforcement members at the mounting side thereof;

a hook member mounted on said front end of said horizontal beam and adapted to press against the top side and the free side of said one of the reinforcement members;

a rotary shaft disposed rotatably in said axial hole of said tubular seat, said shaft having an upper end and a lower end that extends out of said tubular seat and that has a roller mounted thereon, said roller being adapted to be in rolling contact with the floor of the concrete structure; and an operating member including a threaded shank which has a lower section that extends threadedly into said axial hole of said tubular seat via said internally threaded top section of said upper portion and that is coupled to said upper end of said shaft;

whereby, said tubular seat is movable upward or downward relative to said shaft upon rotation of said threaded shank so as to permit raising or lowering of the wall form assembly relative to the floor of the concrete structure to facilitate adjustment of a position of the wall form assembly on the floor.

2. The apparatus of claim 1, wherein said hook member has a mounting portion mounted removably on said front end of said horizontal beam, a downward extension which extends from said mounting portion and which is adapted to press against the free side of said one of the reinforcement members, a horizontal extension which extends from said mounting portion, and a transverse projection formed on said horizontal extension and adapted to press said horizontal beam against the top side of said one of the reinforcement members.

* * * * *